US011891923B2

(12) United States Patent
Boden et al.

(10) Patent No.: US 11,891,923 B2
(45) Date of Patent: Feb. 6, 2024

(54) VALVETRAIN WITH ROCKER SHAFT HOUSING MAGNETIC LATCH

(71) Applicant: Eaton Intelligent Power Limited, Dublin (IE)

(72) Inventors: Adam Boden, Homer, MI (US); Anthony Leon Spoor, Union City, MI (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/638,844

(22) PCT Filed: Sep. 10, 2020

(86) PCT No.: PCT/EP2020/025405

§ 371 (c)(1),
(2) Date: Feb. 27, 2022

(87) PCT Pub. No.: WO2021/047796

PCT Pub. Date: Mar. 18, 2021

(65) Prior Publication Data

US 2022/0333507 A1 Oct. 20, 2022

Related U.S. Application Data

(60) Provisional application No. 62/970,729, filed on Feb. 6, 2020, provisional application No. 62/898,297, filed on Sep. 10, 2019.

(51) Int. Cl.
*F01L 1/18* (2006.01)
*F01L 9/26* (2021.01)
(Continued)

(52) U.S. Cl.
CPC ..... *F01L 1/181* (2013.01); *F01L 9/26* (2021.01); *F01L 13/0005* (2013.01);
(Continued)

(58) Field of Classification Search
CPC ..... F01L 1/181; F01L 9/26; F01L 13/0005; F01L 13/06; F01L 2305/00; F01L 2013/001
(Continued)

(56) References Cited

U.S. PATENT DOCUMENTS 4,252,093 A 2/1981 Hazelrigg
5,613,469 A 3/1997 Rygiel
(Continued)

FOREIGN PATENT DOCUMENTS

CN 102449275 A 5/2012
CN 109072727 A 12/2018
(Continued)

OTHER PUBLICATIONS

International Search Report issued in corresponding application No. PCT/EP2020/025405 dated Jan. 27, 2021, 4 pages.
(Continued)

*Primary Examiner* — Kenneth J Hansen
*Assistant Examiner* — Kelsey L Stanek
(74) *Attorney, Agent, or Firm* — Pearne & Gordon LLP

(57) ABSTRACT

A valvetrain for an internal combustion engine includes a camshaft, an electromagnetic latch assembly, a rocker shaft, and a rocker arm assembly. The rocker arm assembly may include a cam follower configured to engage a cam mounted on the camshaft as the camshaft rotates and a rocker arm configured to rotate on the rocker shaft. The electromagnetic latch assembly may include a pin translatable between a first position and a second position and an electromagnet that causes the pin to actuate. The movement of the pin may provide mode switching for a switching rocker arm, a cylinder deactivating rocker arm, or an engine brake rocker arm. The electromagnet is powered by a circuit that passes through the rocker shaft. The electromagnet may be
(Continued)

mounted to the rocker shaft. Running the circuit through the rocker shaft allows the electromagnet to be powered with wiring that remains stationary.

20 Claims, 10 Drawing Sheets

(51) Int. Cl.
*F01L 13/00* (2006.01)
*F01L 13/06* (2006.01)

(52) U.S. Cl.
CPC ..... *F01L 13/06* (2013.01); *F01L 2013/001* (2013.01); *F01L 2305/00* (2020.05)

(58) Field of Classification Search
USPC ..... 123/90.44
See application file for complete search history.

(56) References Cited

U.S. PATENT DOCUMENTS

| | | | | |
|---|---|---|---|---|
| 6,092,497 | A * | 7/2000 | Preston | F01L 13/0005 123/90.39 |
| 2006/0283412 | A1 | 12/2006 | Tsuruta et al. | |
| 2008/0223325 | A1 | 9/2008 | Meistrick | |
| 2012/0055428 | A1 | 3/2012 | Kidooka | |
| 2017/0009610 | A1 | 1/2017 | Ahmed et al. | |
| 2018/0142583 | A1 * | 5/2018 | Liskar | F01L 1/185 |
| 2018/0195419 | A1 * | 7/2018 | Liskar | F01L 1/053 |
| 2021/0372298 | A1 * | 12/2021 | Hughes | F01L 1/185 |

FOREIGN PATENT DOCUMENTS

| | | | |
|---|---|---|---|
| EP | 1154129 | A1 | 11/2001 |
| EP | 2644854 | A1 | 10/2013 |
| JP | 2000314306 | A | 11/2000 |
| JP | 2008298057 | A | 12/2008 |
| WO | 2014/100185 | A1 | 6/2014 |
| WO | 2017/156125 | A2 | 9/2017 |
| WO | 2019/010013 | A1 | 1/2019 |
| WO | 2019/091874 | A1 | 5/2019 |

OTHER PUBLICATIONS

Written Opinion issued in corresponding application No. PCT/EP2020/025405 dated Jan. 27, 2021, 7 pages.

* cited by examiner

VALVETRAIN WITH ROCKER SHAFT HOUSING MAGNETIC LATCH

REFERENCE TO RELATED APPLICATION

This application claims the benefit of U.S. Provisional Application No. 62/898,297, filed on Sep. 10, 2019, and U.S. Provisional Application No. 62/970,729, filed on Feb. 6, 2020, the contents of which are incorporated herein by reference in their entirety.

FIELD

The present teachings relate to valvetrains, particularly valvetrains providing switching rocker arms that implement variable valve lift (VVL), cylinder deactivation (CDA), or engine braking.

BACKGROUND

Hydraulically actuated latches are used on some rocker arm assemblies to implement variable valve lift (VVL), cylinder deactivation (CDA), or engine braking. For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an engine control unit (ECU).

SUMMARY

Complexity and demands for oil in some valvetrain systems can be reduced by replacing hydraulically latched rocker arm assemblies with electrically latched rocker arm assemblies, but electrically latched rocker arm assemblies present challenges. One challenge is the placement of the electromagnet. If the electromagnet is located apart from the rocker arm assembly, there is the challenge of forming a reliable mechanical interface with the moving rocker arm assembly. If the electromagnet is located on the moving rocker arm assembly, there is the challenge of providing power to the electromagnet. The motion of the rocker arm assembly may cause a wire to be caught, clipped, or fatigued and consequently short out.

Some aspects of the present teachings relate to a valvetrain for an internal combustion engine of a type that has a combustion chamber and a moveable valve having a seat formed in the combustion chamber. The valvetrain may include a camshaft, an electromagnetic latch assembly, a rocker shaft, and a rocker arm assembly. The rocker arm assembly may include a cam follower configured to engage a cam mounted on the camshaft as the camshaft rotates and a rocker arm configured to pivot on the rocker shaft. The electromagnetic latch assembly may include a pin translatable between a first position and a second position and an electromagnet that causes the pin to actuate. One of the first and second pin positions may provide a rocker arm assembly configuration in which the rocker arm assembly is operative to actuate the moveable valve in response to rotation of the camshaft to produce a first valve lift profile. The other of the first and second pin positions may provide a rocker arm assembly configuration in which the rocker arm assembly is operative to actuate the valve in response to rotation of the camshaft to produce a second valve lift profile, which is distinct from the first valve lift profile, or may deactivate the valve. In some embodiments, the electromagnet is mounted to the rocker shaft. The rocker arm assembly may be a switching rocker arm, a cylinder deactivating rocker arm, an engine brake rocker arm, or the like.

In accordance with the present teachings, the electromagnet is powered by a circuit that passes through the rocker shaft. The circuit may include the electromagnet, a power source, and a conductor of the circuit that passes through the rocker shaft. The conductor may be isolated from ground. In some embodiments, the conductor is a wire. In some embodiments, the circuit includes two wires that pass through the rocker shaft. The wiring may connect to the electromagnet through one or more contacts. In some embodiments, the electromagnetic latch assembly forms connections with the one or more contacts as the electromagnetic latch assembly is installed in a chamber within the rocker shaft through an opening in a side of the rocker shaft. Running the wiring through the rocker shaft and mounting the electromagnet to the rocker shaft allows the electromagnet to be powered with wiring that is stationary.

In some aspects of the present teachings, the rocker shaft forms a chamber that houses the electromagnet. In some of these teaching the electromagnetic latch assembly further comprises a permanent magnet the is mounted within the chamber. In some embodiments, the permanent magnet remains within the chamber even as the pin translates between the first position and the second position. In some of these teachings, the chamber is sealed to exclude metal particles suspended in oil, which may be dispersed in the environment surrounding the rocker arm. Housing the electromagnet or the permanent magnet within the rocker shaft may reduce any tendency of the magnets to attract metal particles that could interfere with pin actuation.

In some of these teachings, the permanent magnet is mounted to remain stationary with respect to the rocker shaft. Fixing the permanent magnet to the rocker shaft means not fixing the permanent magnet to an armature, the pin, or another component that moves with the armature or the pin. Taking the weight of the permanent magnet off the pin and any associated moving parts may increase actuation speed and allow the use of a smaller electromagnet.

In some of these teachings, both an electromagnet and a permanent magnet of the electromagnetic latch assembly are installed within the chamber. In some of these teachings, the permanent magnet is installed within the electromagnet. In some of these teachings, the electromagnetic latch assembly includes two permanent magnets arranged with confronting polarities and with a pole piece of magnetically susceptible material between them. In some of these teachings, the magnetically susceptible material is a low coercivity ferromagnetic material. The magnets and the pole piece are held in fixed positions relative to the rocker shaft and arranged about an opening through which the pin translates. In some of these teaching, an additional pole piece bounds the opening. The permanent magnets may also bound the opening. In some of these teachings, the pole piece bounds the opening more narrowly than the permanent magnets, whereby an armature contacts the pole piece but does not contact either of the permanent magnets. In this configuration, the pole piece helps secure the armature against rocking while the permanent magnets are relieved of stress.

In some aspects of the present teachings, the electromagnetic latch assembly provides the armature with positional stability independently from the electromagnet when the armature is in an extended position and when the armature is in a retracted position. This dual positional stability enables the electromagnetic latch assembly to maintain the pin in either the first position or the second position without power to the electromagnet. An electromagnet usually takes the form of a coil. The force exerted by the electromagnet on the armature depends on the number of windings in the coil. Accordingly, a minimum number of windings for the coil is determined by a force required for reliable actuation. To make the coil small enough to fit within the rocker shaft may dictate a narrow gauge wire. The narrower the wire gauge, the more heat is produced by the coil. The combination of high heat production and slow heat dissipation from within the rocker shaft means that in some applications the electromagnet inside the rocker shaft can be operated only for brief periods before overheating. Dual positional stability enables the electromagnet to be operated with only short bursts of power that avoid overheating.

In some of these teachings, a permanent magnet contributes to the positional stability of the armature both when the armature is in the extended position and when the armature is in the retracted position. According to some further aspects of these teachings, the electromagnetic latch assembly is structured to operate through a magnetic circuit-shifting mechanism. In some of these teachings, absent any magnetic fields generated by the electromagnet or other external sources, when the armature is in the extended position, an operative portion of the magnetic flux from the permanent magnet follows a first magnetic circuit and when the armature is in the retracted position, an operative portion of the magnetic flux from the permanent magnet follows a second magnetic circuit distinct from the first magnetic circuit. The electromagnet may be operative to redirect the permanent magnet's flux away or toward one or the other of these magnetic circuits and thereby cause the armature to actuate. In some of these teachings redirecting the magnetic flux includes reversing the magnetic polarity in a low coercivity ferromagnetic element forming part of both the first and second magnetic circuits. An electromagnetic latch assembly structured to be operable through a magnetic circuit-shifting mechanism may be smaller than one that is not so structured and may be operative with a smaller electromagnet.

In some of these teaching, the electromagnet encircles a volume within which a portion of the armature comprising low coercivity ferromagnetic material translates and the electromagnetic latch assembly comprises one or more pole pieces of low coercivity ferromagnetic material outside the volume encircled by the electromagnet. The one or more pole pieces outside the volume encircled by the electromagnet may form a capped can around the electromagnet. Both the first and the second magnetic circuits pass through the armature portion formed of low coercivity ferromagnetic material. In some of these teachings, the first magnetic circuit passes around the outside of the electromagnet via the one or more pole pieces while the second magnetic circuit does not pass around the outside of the electromagnet. This characteristic of the second magnetic circuit reduces magnetic flux leakage and increases the force with which the permanent magnet holds the armature in the retracted position.

In some of these teachings, the electromagnetic latch assembly includes a second permanent magnet distal from the first permanent magnet and fulfilling a complimentary role. The electromagnetic latch assembly may provide two distinct magnetic circuits for the second permanent magnet, one or the other of which is the path taken by an operative portion of the magnet flux from the second permanent magnet depending on the whether the armature is in the extended position or the retracted position. The path taken when the armature is in the retracted position may pass around the outside of the electromagnet via the pole pieces. The path taken when the armature is in the extended position may be a shorter path that does not pass around the outside of the electromagnet. One or the other of the permanent magnets may then provide a high holding force depending on whether the armature is in the extended position or the retracted position. In some of these teachings, both permanent magnets contribute to the positional stability of the armature in both the extended position or the retracted position. In some of these teachings, the two magnets are arranged with confronting polarities. In some of these teachings, the two magnets are located at distal ends of the volume encircled by the electromagnet. In some of these teachings, the permanent magnets are annular in shape and polarized along the directions of their axis. These structures may be conducive to providing a compact and efficient design. Whether the armature is in the extended position or the retracted position, the armature is held by magnetic flux following a short flux path, resulting in low flux leakage and allowing the permanent magnets to be made smaller.

In some of the present teaching, the circuit that powers the electromagnet is operable to energize the electromagnet with a current in either a first direction or a second direction, which is the reverse of the first direction. An electromagnetic latch assembly having dual positional stability may require the electromagnet current to be in one direction for latching and the opposite direction for unlatching. The electromagnet powered with current in the first direction may be operative to actuate the armature from the extended position to the retracted position. The electromagnet powered with current in the second direction may be operative to actuate the armature from the retracted position to the extended position.

In some embodiments, the circuit includes a first wire that is isolated from ground and components such as capacitors and switches operable to provide the first wire with voltage at a potential that is either above ground or below ground. The circuit may include a second wire that is grounded, or the circuit may form a ground connection through a structural component of the valvetrain such as a valve, the camshaft, or the rocker shaft. Accordingly, the electromagnet may be powered using a single wire that passes through the rocker shaft. A bore may be formed in the rocker shaft to house the first wire or the first wire and the second wire. In some embodiments, the bore extends along a length of the rocker shaft.

In some of the present teachings, the electromagnet of the electromagnetic latch assembly is installed in a chamber within the rocker shaft through an opening of the chamber onto a perimeter of the rocker shaft. In some of these teachings, wiring for the electromagnet may enter the chamber through a passage extending lengthwise along the rocker shaft. The wiring may terminate in one or more contacts configured to forms connections with the electromagnet as the electromagnetic latch assembly is inserted into the rocker shaft.

In some aspects of the present teachings, the armature includes a driving member. The driving member may be a large diameter structure at one end of the armature. In some embodiments, a diameter of the driving member is approximately the same as a diameter of the electromagnetic latch assembly. The driving member may substantially block an opening in the rocker shaft through which the electromagnetic latch assembly is installed in the rocker shaft.

In some of these teachings, the armature is decoupled from the pin. The armature may be entirely or almost entirely within the rocker shaft in both the extended and the retracted position. The pin, on the other hand, may be partially or entirely within a rocker arm that pivots on the rocker shaft. In some embodiments, the pin pivots about the rocker shaft in conjunction with the rocker arm. Decoupling the pin from the armature allows the pin to move independently from the armature when the rocker arm pivots about the rocker shaft. In some embodiments, the rocker arm pivots about the rocker shaft in only one of the latching and non-latching configurations. In some embodiments, the rocker arm pivots about the rocker shaft in both of the latching and non-latching configurations. In some embodiments, the driving member of the armature abuts the pin at least when the cam is on base circle. In some embodiments, a spring biases the pin against the armature.

In some of the present teachings, the electromagnetic latch assembly includes a decoupling member positioned between the pin and the armature. When the pin is in the first position, the decoupling member is within the rocker shaft and pivots with the rocker shaft. When the pin is in the second position, the decoupling member is outside the rocker shaft and pivots with the rocker arm. In some of these teachings, the armature includes a driving member that abuts the decoupling member and a diameter of the driving member equals a diameter of the decoupling member. These features may reduce the risk of shearing of part ends that align at a rocker shaft/rocker arm interface. The decoupling member may be a disc. In some of these teachings, the edges of the parts that align at that interface are rounded or tapered.

In some embodiments, the rocker arm assembly includes a first rocker arm and a second rocker arm and the pin selectively latches the first rocker arm and the second rocker arm together. If the camshaft is rotated while the pin is in the latching position, the cam causes the first rocker arm and the second rocker to pivot as a unit on the rocker shaft. If the camshaft is rotated while the pin is in the non-latching position, the first rocker arm remains stationary on the rocker shaft. The second rocker arm may be connected to the first rocker arm by a pivot pin. If the camshaft is rotated while the pin is in the non-latching, the second rocker arm may pivot relative to the first rocker arm on the pivot pin.

In some embodiments, the rocker arm assembly includes only one rocker arm, which may be an engine brake rocker arm. The pin may engage a castellation structure having an upper portion and a lower portion. In the first pin position the upper portion and the lower portion may engage to provide a valve-activated configuration. In the second pin position the upper portion and the lower portion may disengage to provide a valve-deactivated configuration.

Some aspects of the present teachings relate to a valvetrain for an internal combustion engine of a type that has a combustion chamber, a moveable valve having a seat formed in the combustion chamber, and a camshaft. The valvetrain includes a rocker shaft, a camshaft, a rocker arm assembly, and an electromagnetic latch assembly. The rocker arm assembly includes a cam follower configured to engage a cam mounted on the camshaft as the camshaft rotates and a rocker arm pivotally mounted on the rocker shaft. The electromagnetic latch assembly includes an electromagnetic powered through a circuit that passes through the rocker shaft.

Some aspects of the present teachings relate to a method of providing power to an electromagnetic latch assembly for a valvetrain of a type that includes a rocker arm mounted on a rocker shaft. The method includes connecting the electromagnetic latch assembly to a power source through wiring that passes through the rocker shaft and using the wiring to deliver a voltage pulse from the power sufficient to actuate the electromagnetic latch assembly. In some of these teachings, the method further includes using one or more permanent magnets to alternately maintain the electromagnetic latch assembly in a latching and a non-latching position.

The primary purpose of this summary has been to present broad aspects of the present teachings in a simplified form to facilitate understanding of the present disclosure. This summary is not a comprehensive description of every aspect of the present teachings. Other aspects of the present teachings will be conveyed to one of ordinary skill in the art by the following detailed description together with the drawings.

DETAILED DESCRIPTION

Figure 1A:
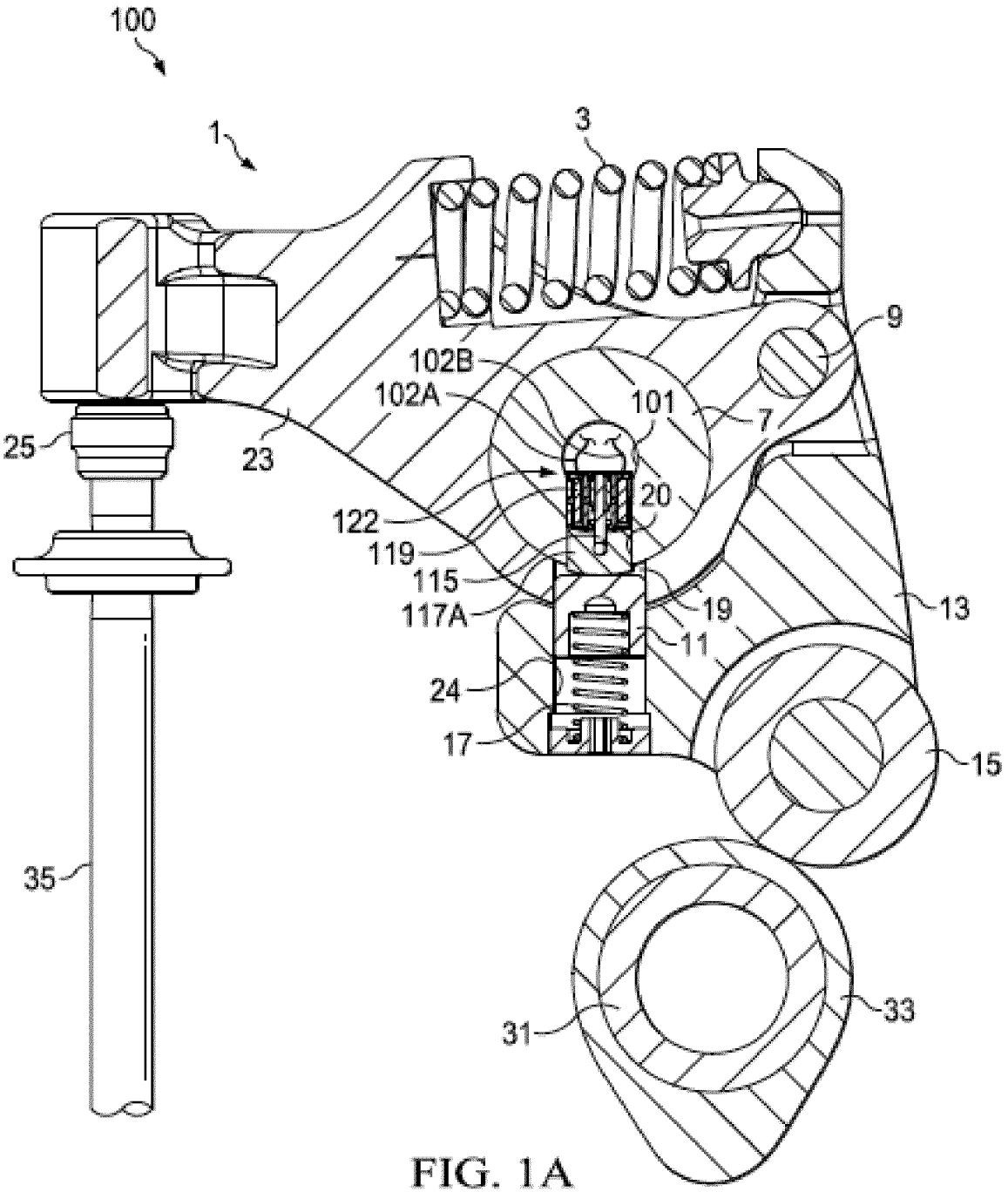
FIG. 1A is a cross-sectional side view of a rocker arm assembly according to some aspects of the present teachings with a latch pin in a latching position and with a cam on base circle.

FIGS. 1A-2B illustrate a portion of a valvetrain 100 according some aspects of the present teachings. The valvetrain 100 includes a rocker arm assembly 1, an electromagnetic latch assembly 122, a rocker shaft 7, a camshaft 31, a valve 35, and a cam 33 on the camshaft 31. The rocker arm assembly 1 includes a first rocker arm 23 pivotally mounted on the rocker shaft 7 and a second rocker arm 13 pivotally connected to the first rocker arm 23 through a pivot pin 9. A lost motion spring 3 is positioned between the first rocker arm 23 and the second rocker arm 13. A cam follower 15 is mounted on the second rocker arm 13 and is configured to engage the cam 33 as the camshaft 31 rotates.

The electromagnetic latch assembly 122 includes an electromagnet 119 that is housed in the rocker shaft 7 and a latch pin 11. The electromagnet 119 is operable to cause the latch pin 11 to actuate between a latching position in which the latch pin 11 engages the first rocker arm 23 and the second rocker arm 13 and prevents the first rocker arm 23 and the second rocker arm 13 from undergoing relative rotation on the pivot pin 9 and a non-latching position in which the first rocker arm 23 and the second rocker arm 13 are able to undergo relative rotation on the pivot pin 9.

Figure 1B:
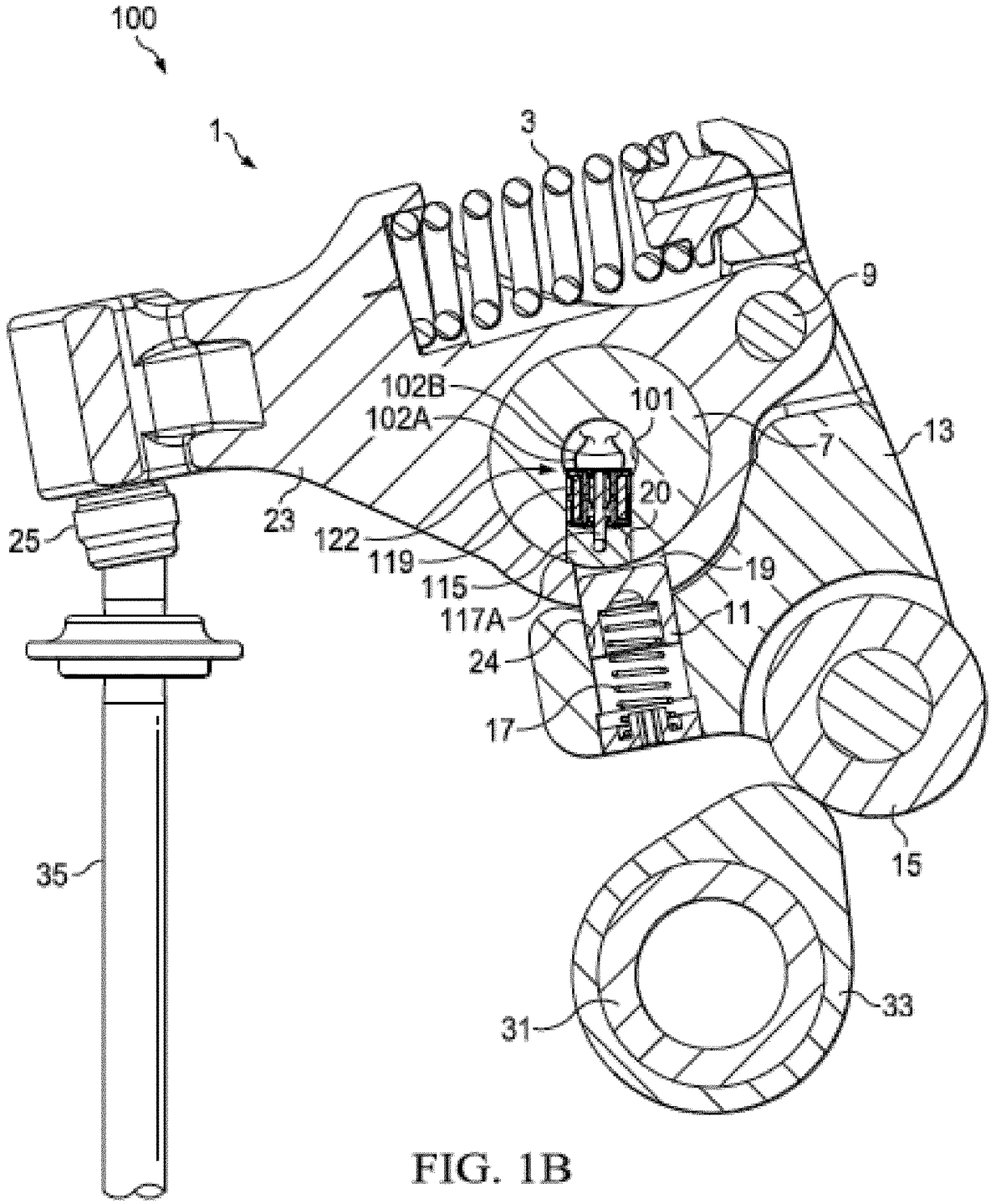
FIG. 1B provides the view of FIG. 1A but with the cam on lift.

In FIG. 1A, the latch pin 11 is in a latching position and the cam 33 is on base circle. Base circle is a portion of the cam cycle in which the cam 33 is not lifting the second rocker arm 13. In the latching position, the latch pin 11 is partially within a bore 19 in the first rocker arm 23 and partially within a bore 24 in the second rocker arm 13, whereby the latch pin 11 latches the first rocker arm 23 and the second rocker arm 13 together. If while the latch pin 11 is in the latching position the cam follower 15 is lifted by rotating the cam 33 off base circle as shown in FIG. 1B, the first rocker arm 23 and the second rocker arm 13 will rotate as a unit on the rocker shaft 7. The rocker arm assembly 1 will bear down on a valve foot 25 opening the valve 35. The rotation may be reversed under the action of a valve spring (not shown) as the cam 33 drops back down to base circle.

The electromagnet 119 is operable to alternately extend and retract an armature 115. The armature 115 interfaces with the latch pin 11 through a driving member 117A that is attached to and may be considered part of the armature 115. The driving member 117A abuts but is not connected to the latch pin 11, whereby the armature 115 is decoupled from the latch pin 11. A spring 17 mounted on the second rocker arm 13 may be used to drive the latch pin 11 against the driving member 117A. Using the electromagnet 119, a force may be applied to the armature 115 that is sufficient to overcome the spring 17 and push the latch pin 11 out of the first rocker arm 23 through a bore 19 in the first rocker arm 23 to produce the unlatched configuration shown in FIGS. 2A and 2B.

Figure 2A:
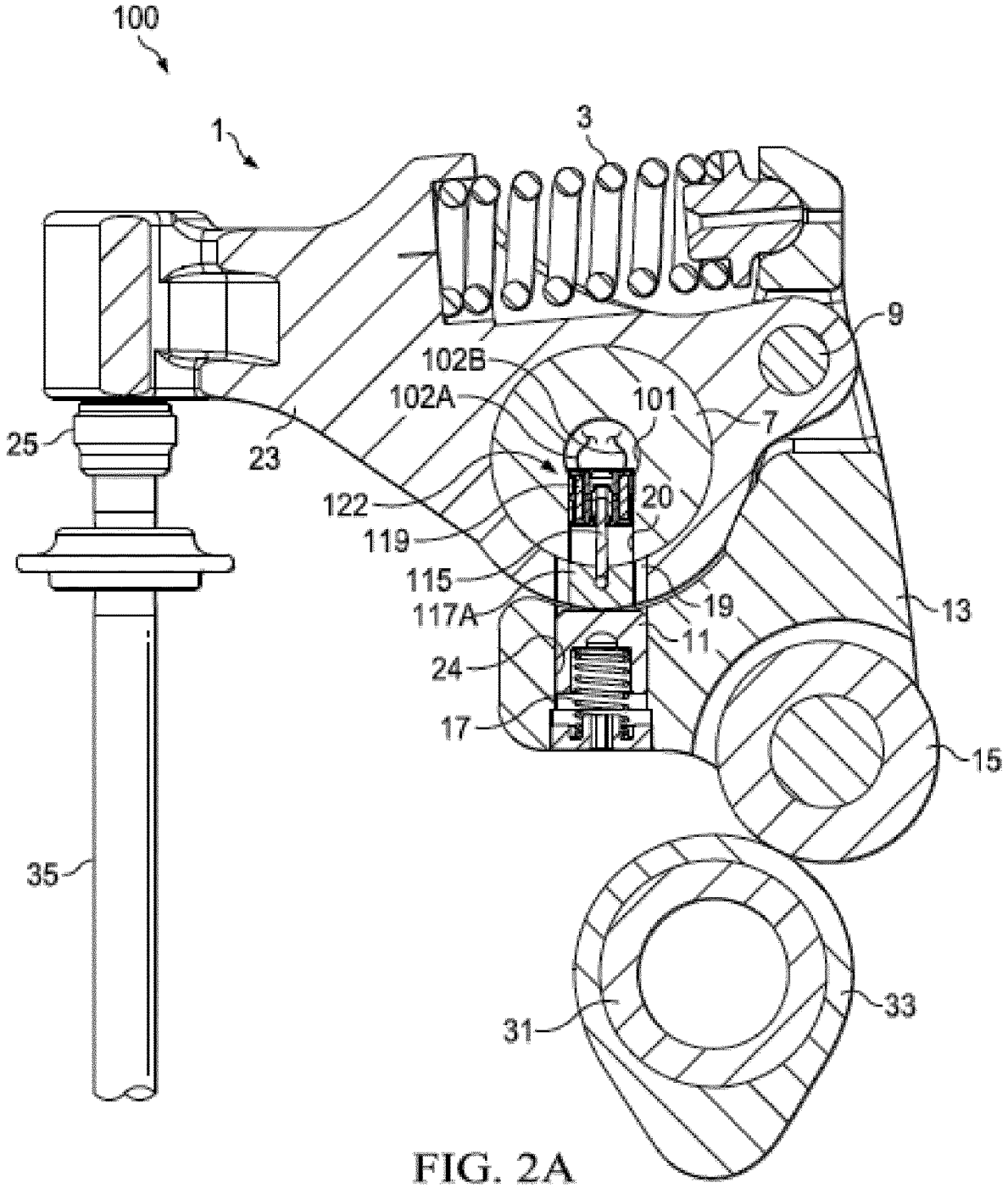
FIG. 2A provides the view of FIG. 1A but with the latch pin in a non-latching position.
Figure 2B:
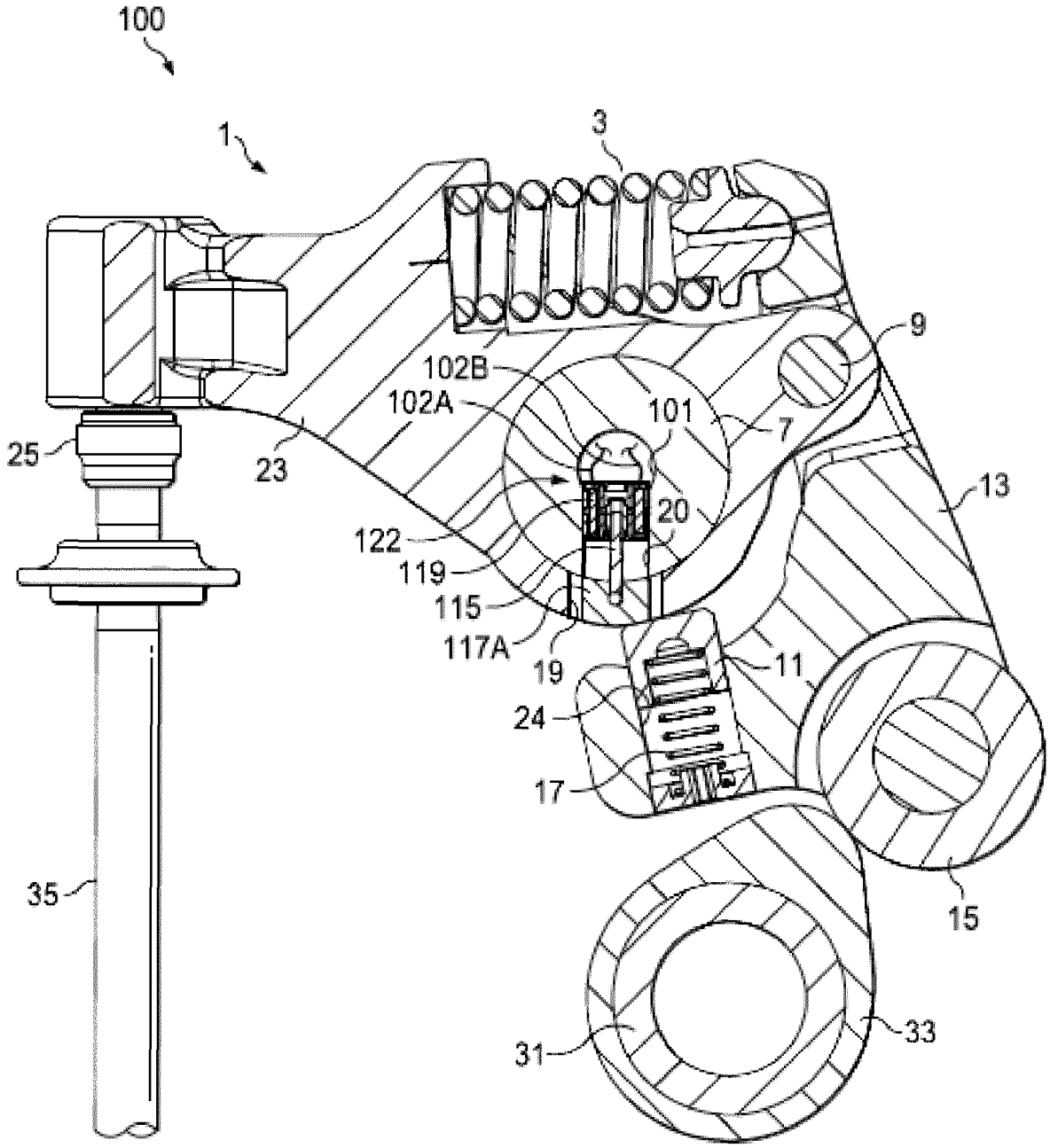
FIG. 2B provides the view of FIG. 2A but with the cam on lift.

FIG. 2A illustrates the rocker arm assembly 1 with the latch pin 11 in a non-latching position and the cam 33 on base circle. In the non-latching position, the latch pin 11 is nearly or entirely outside the bore 19 in the first rocker arm 23, whereby the second rocker arm 13 may rotate relative to the first rocker arm 23 on the pivot pin 9. In some embodiments, the non-latching position places the latch pin 11 entirely or almost entirely within the second rocker arm 13. If while the latch pin 11 is in the non-latching position the cam follower 15 is lifted by rotating the cam 33 off base circle as shown in FIG. 2B, the second rocker arm 13 will rotate on the pivot pin 9 compressing a lost motion spring 3 while the first rocker arm 23 of the and the valve foot 25 remain stationary (unless driven by a separate cam). The rotation of the second rocker arm 13 on the pivot pin 9 will be reversed by the lost motion spring 3 when the cam drops back toward base circle.

In some embodiments, the latch pin 11 remains in contact with the driving member 117A throughout the range of motion that the second rocker arm 13 has relative to the first rocker arm 23. In some embodiments, the latch pin 11 moves out of contact with the driving member 117A but slides back over the driving member 117A as the cam 33 returns to base circle. The latch pin 11 may slide over a surface of the rocker arm 23 while the cam 33 is on lift. If the armature 115 is retracted while the cam 33 is on lift, the latch pin 11 may slide over and into the bore 19 as the cam 33 returns to base circle. Over extension of the driving member 117A may be prevented by the armature 115. Over extension of the latch pin 11 may be prevented by contact with the rocker arm 23.

Figure 3:
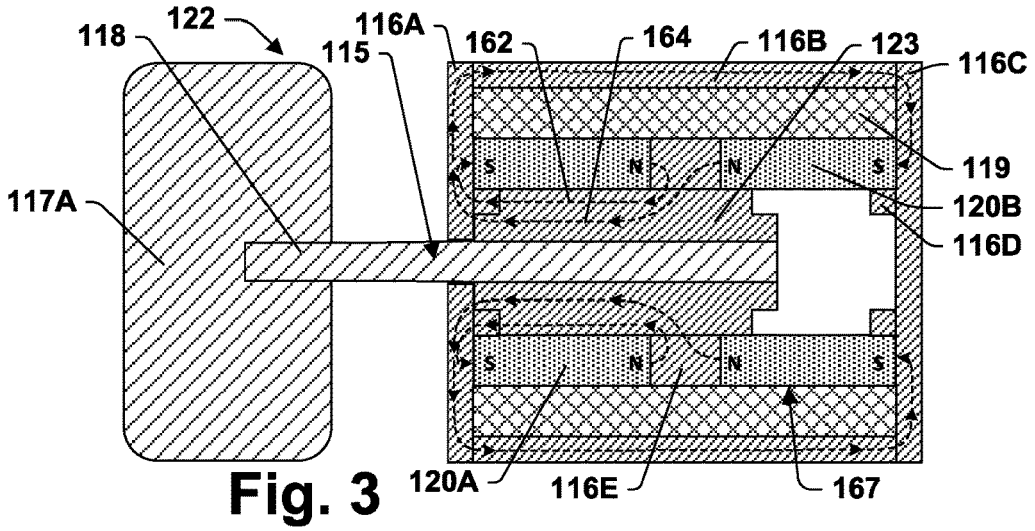
FIG. 3 is a cross-sectional side view of an electromagnetic latch assembly according to some aspects of the present teachings with the latch pin in an extended position.

In accordance with some aspects of the present teachings, components of the electromagnetic latch assembly 122 are mounted within a chamber 20 formed in the rocker shaft 7. As shown in FIG. 3, the electromagnetic latch assembly 122 includes the electromagnet 119, a permanent magnet 120A, and a permanent magnet 120B, each of which is rigidly mounted to the rocker shaft 7 within the chamber 20. These parts may be rigidly mounted to the rocker shaft 7 by being rigidly mounted to other parts that are themselves rigidly mounted to the rocker shaft 7. The electromagnetic latch assembly 122 further includes the armature 115 and pole pieces 116A, 116B, 116C, 116D, and 116E. The permanent magnets 120A and 120B are functional to hold the driving member 117A in the extended position against the force of the spring 17 even if power to the electromagnet 119 is cut.

The armature 115 includes a paramagnetic core 118, driving member 117A, and a ferromagnetic ferrule 123. The ferromagnetic ferrule 123 provides a low reluctance pathway for magnetic circuits passing through the armature 115 and facilitates the application of magnetic forces to the armature 115.

The pole pieces 116A-116E are structures made with low coercivity ferromagnetic material and are operative within the electromagnetic latch assembly 122 to guide magnetic flux from the poles of the permanent magnets 120A and 120B. The pole pieces 116A, 116B, and 116C are located outside the electromagnet 119 and may form a shell around it. The pole pieces 116D may provide stepped edges in magnetic circuits formed by the electromagnetic latch assembly 122. The ferromagnetic ferrule 123 of the armature 115 may be shaped to mate with these edges. During actuation, magnetic flux may cross an air gap between one of these stepped edges and the armature 115, in which case the stepped edges may be operative to increase the magnetic forces through which the armature 115 is actuated.

The electromagnet 119 may include a coil having a large number of wire loops that wrap around a volume 167. The permanent magnets 120A and 120B may be positioned within the volume 167 and be held in fixed positions within the volume 167. The pole pieces 116D and 116E may also be positioned within the volume 167. The permanent magnets 120A and 120B may be arranged with confronting polarities. The pole piece 116E may be positioned between the confronting poles and provides a pole piece for each of the permanent magnets 120A and 1206. The permanent magnets 120A and 120B may be located at distal ends of the volume 167. The permanent magnets 120A and 120B may be annular in shape and polarized in a direction parallel to that in which the armature 115 translates. This may be along a central axis for the electromagnet 119.

The electromagnetic latch assembly 122 provides both extended and retracted positions in which the armature 115 is stable. As a consequence, either the latch pin 11 can be stably maintained in either the latching or the non-latching position without the electromagnet 119 being powered. The stability referred to here is a tendency of the armature 115 to remain in and return to a particular position. Stability is provided by restorative forces that act against small perturbations of the armature 115 from a stable position. In the electromagnetic latch assembly 122, stabilizing forces are provided by the permanent magnets 120A and 120B. Alternatively or in addition, one or more springs may be positioned to provide positional stability. Springs may also be used to bias the armature 115 out of a stable position, which may be useful for increasing actuation speed.

Figure 5:
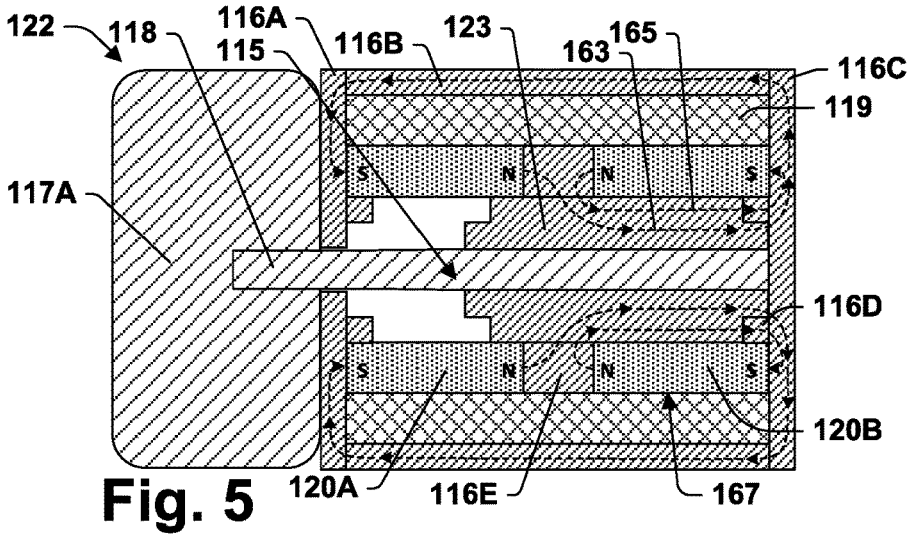
FIG. 5 provides the view of FIG. 3 but with the latch pin in a retracted position.

As shown in FIGS. 3 and 5, the permanent magnet 120A stabilizes the armature 115 in both the extended and the retracted positions. Electromagnetic latch assembly 122 forms two distinct magnetic circuits 162 and 163 to provide this functionality. As shown in FIG. 3, the magnetic circuit 162 is the primary path for an operative portion of the magnet flux from the permanent magnet 120A when the armature 115 is in the extended position, absent magnetic fields from the electromagnet 119 or any external source that might alter the path taken by flux from the permanent magnet 120A.

The magnetic circuit 162 proceeds from the north pole of the permanent magnet 120A, through the pole piece 116E, through the armature 115, through the pole piece 116D and the pole piece 116A and ends at the south pole of the permanent magnet 120A. The magnetic circuit 162 is the primary path for an operative portion of the magnet flux from the permanent magnet 120A when the armature 115 is in the extended position. A magnetic circuit is a primary path if it is a path taken by the majority of the flux. Perturbation of the armature 115 from the extended position would introduce an air gap into the magnetic circuit 162, increasing its magnetic reluctance. Therefore, the magnetic forces produced by the permanent magnet 120A resist such perturbations.

As shown in FIG. 5, the magnetic circuit 163 is the primary path for an operative portion of the magnet flux from the permanent magnet 120A when the armature 115 is in the retracted position, absent magnetic fields from the electromagnet 119 or any external source that might alter the path taken by flux from the permanent magnet 120A. The magnetic circuit 163 proceeds from the north pole of the permanent magnet 120A, through the pole piece 116E, through the armature 115, through the pole piece 116D, through the pole pieces 116C, 116B, and 116A, and ends at the south pole of the permanent magnet 120A. The magnetic circuit 163 is the primary path for an operative portion of the magnet flux from the permanent magnet 120A when the armature 115 is in the retracted position. Perturbations of the armature 115 from the retracted position would introduce an air gap into magnetic circuit 163, increasing its magnetic reluctance. Therefore, the magnetic forces produced by the permanent magnet 120A resist such perturbations.

In accordance with some aspects of the present teachings, the second permanent magnet 120B is also operative to stabilize the armature 115 in both the extended and the retracted positions. The electromagnetic latch assembly 122 forms two distinct magnetic circuits 164 and 165 for magnetic flux from the second permanent magnet 120B. The magnetic circuit 164 is the primary path for an operative portion of the magnet flux from the permanent magnet 1206 when the armature 115 is in the extended position and the magnetic circuit 165 is the primary path for an operative portion of the magnet flux from permanent magnet 1206 when the armature 115 is in the retracted position. Like the magnetic circuit 162, the magnetic circuit 165 goes around the outside of the electromagnet 119. Like magnetic circuit 163, the magnetic circuit 164 does not.

Figure 4:
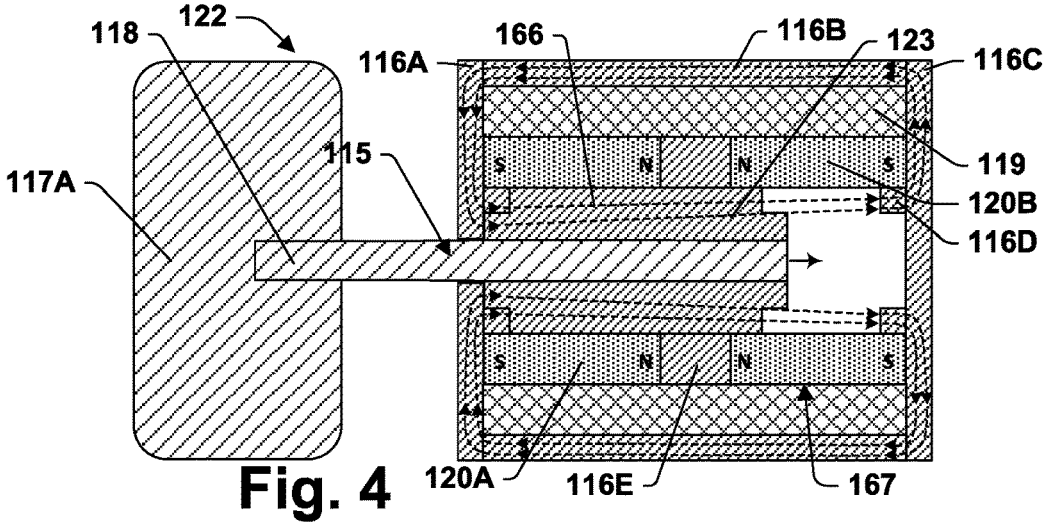
FIG. 4 provides the same view as FIG. 3, but illustrating magnetic flux that may be generated by the electromagnet.

The electromagnetic latch assembly 122 is structured to operate through a magnetic circuit-shifting (flux path-shifting) mechanism. The electromagnetic latch assembly 122 is operative to actuate the armature 115 between the extended and retracted positions by redirecting flux from the permanent magnets 120A and 120B. FIG. 4 illustrates the mechanism for this action in the case of operating the electromagnet 119 to induce the armature 115 to actuate from the extended position to the retracted position. A voltage of suitable polarity may be applied to the electromagnet 119 to induce magnetic flux following the circuit 166. The magnetic flux from the electromagnet 119 reverses the magnetic polarity in low coercivity ferromagnetic elements forming the magnetic circuits 162 and 164 through which the permanent magnets 120A and 120B stabilized the armature 115 in the extended position. This greatly increase the reluctance of the magnetic circuits 162 and 164. Magnetic flux from the permanent magnets 120A and 120B may shift from the magnetic circuits 162 and 164 toward magnetic the circuits 163 and 165. The net magnetic forces on the armature 115 may drive it to the retracted position shown in FIG. 5. In accordance with some aspects of the present teachings, the total air gap in the magnetic circuit 161 taken by flux from the electromagnet 119 does not vary as the armature 115 actuates. This feature may relate to operability through a magnetic circuit-shifting mechanism.

One way in which the electromagnetic latch assembly 122 may be identified as having a structure that provides for a magnetic circuit-shifting mechanism is that the electromagnet 119 does not need to do work on the armature 115 throughout its traverse from the extended position to the retracted position or vis-versa. While the permanent magnets 120A and 120B may initially holds the armature 115 in a first position, at some point during the armature 115's progress toward the second position, the permanent magnets 120A and 120B begins to attract the armature 115 toward the second position. Accordingly, at some point during the armature 115's progress, the electromagnet 119 may be disconnected from its power source and the armature 115 will still complete its travel to the second position. And as a further indication that a magnetic circuit-shifting mechanism is formed by the structure, a corresponding statement may be made in operation of the electromagnet 119 to induce actuation from the second position back to the first. Put another way, a permanent magnet 120A or 120B that is operative to attract the armature 115 into the first position is also operative to attract the armature 115 into the second position.

As used herein, a permanent magnet is a high coercivity ferromagnetic material with residual magnetism. A high coercivity means that the polarities of the permanent magnets 120A and 120B remains unchanged through hundreds of operations through which the electromagnetic latch assembly 122 is operated to switch the armature 115 between the extended and retracted positions. Examples of high coercivity ferromagnetic materials include compositions of AlNiCo and NdFeB.

The magnetic circuits 162, 163, 164, 165 may be formed by low coercivity ferromagnetic material, such as soft iron. The magnetic circuits 162, 163, 164, 165 may have low magnetic reluctance. In accordance with some aspects of the present teachings, the permanent magnets 120A and 120B each have at least one low reluctance magnetic circuit available to them in each of the extended and the retracted positions. These paths may be operative as magnet keepers, maintaining polarization and extending the operating lives of the permanent magnets 120A and 120B.

The pole pieces 116A-116E may form a shell or can around the electromagnet 119. In some of these teachings, the rocker shaft 7 is formed of a low coercivity ferromagnetic material, such as a suitable steel, and the rocker shaft 7 is operative as an adjunct to or replacement for one or more of the pole pieces 116A-116E.

In accordance with some aspects of the present teachings, the magnetic circuits 162 and 165 are short magnetic circuits between the poles of the permanent magnets 120A and 120B respectively. The magnetic circuits 162 and 165 pass through the ferromagnetic ferrule 123 of the armature 115 but not around the wire loops of the electromagnet 119. These short magnetic circuits may reduce magnetic flux leakage and allow the permanent magnets 120A and 120B to provide a high holding force for the armature 115. The magnetic circuits 163 and 164, on the other hand, pass around the wire loops of the electromagnet 119. Routing these magnetic circuits around the outside of the electromagnet 119 may keep them from interfering with the shorter magnetic circuits. These longer, alternate magnetic circuits can allow the permanent magnets 120A and 120B to contribute to stabilizing the armature 115 in both extended and retracted positions and can assure there is a low reluctance magnetic circuit to help maintain the polarization of the permanent magnets 120A and 1206 regardless of whether the armature 115 is in the extended or the retracted position.

In accordance with some aspects of the present teachings, the electromagnet 119 is powered through a circuit that passes through the rocker shaft 7. The circuit may include the electromagnet 119, a power source, and a first wire 102A that passes through the rocker shaft 7. The circuit may include a second wire 1026 that also passes through the rocker shaft 7. The first wire 102A and the second wire 1026 may be disposed in a bore 101 that extends along a length of the rocker shaft 7.

In some embodiment, the circuit allows the polarity of a voltage applied to electromagnet 119 to be reversed. In this circuit, at least the wire 102A is isolated from ground. The rocker shaft 7 may be at a ground potential and may be used to form a ground connection for the circuit. Accordingly, the wire 1026 is optional. In some embodiments, the circuitry includes two wires that pass through the rocker shaft 7.

A conventional solenoid switch forms a magnetic circuit that include an air gap, a spring that tends to enlarge the air gap, and an armature moveable to reduce the air gap. Moving the armature to reduce the air gap reduces the magnetic reluctance of that circuit. As a consequence, energizing a conventional solenoid switch causes the armature to move in the direction that reduces the air gap regardless of the direction of the current through the solenoid's electromagnet or the polarity of the resulting magnetic field. While a conventional solenoid may be used, the electromagnet 119 is operative to drive the armature 115 in either a first direction or an opposite direction depending on the polarity of the magnetic field generated by the electromagnet 119. The circuit may include an H-bridge, for example, to allow the polarity of the applied voltage to be reversed and enable the operation of electromagnetic latch assembly 122 for actuating armature 115 to either an extended position or a retracted position. In some embodiments, the circuit is operative to pulse a single wire with a voltage that is alternately above or below ground, whereby the electromagnet 119 may be powered through a single conductor that is isolated from ground. A pulse at a voltage above ground may be provided directly from the power source while a pulse at a voltage below ground may be provided using a capacitor.

Figure 6:
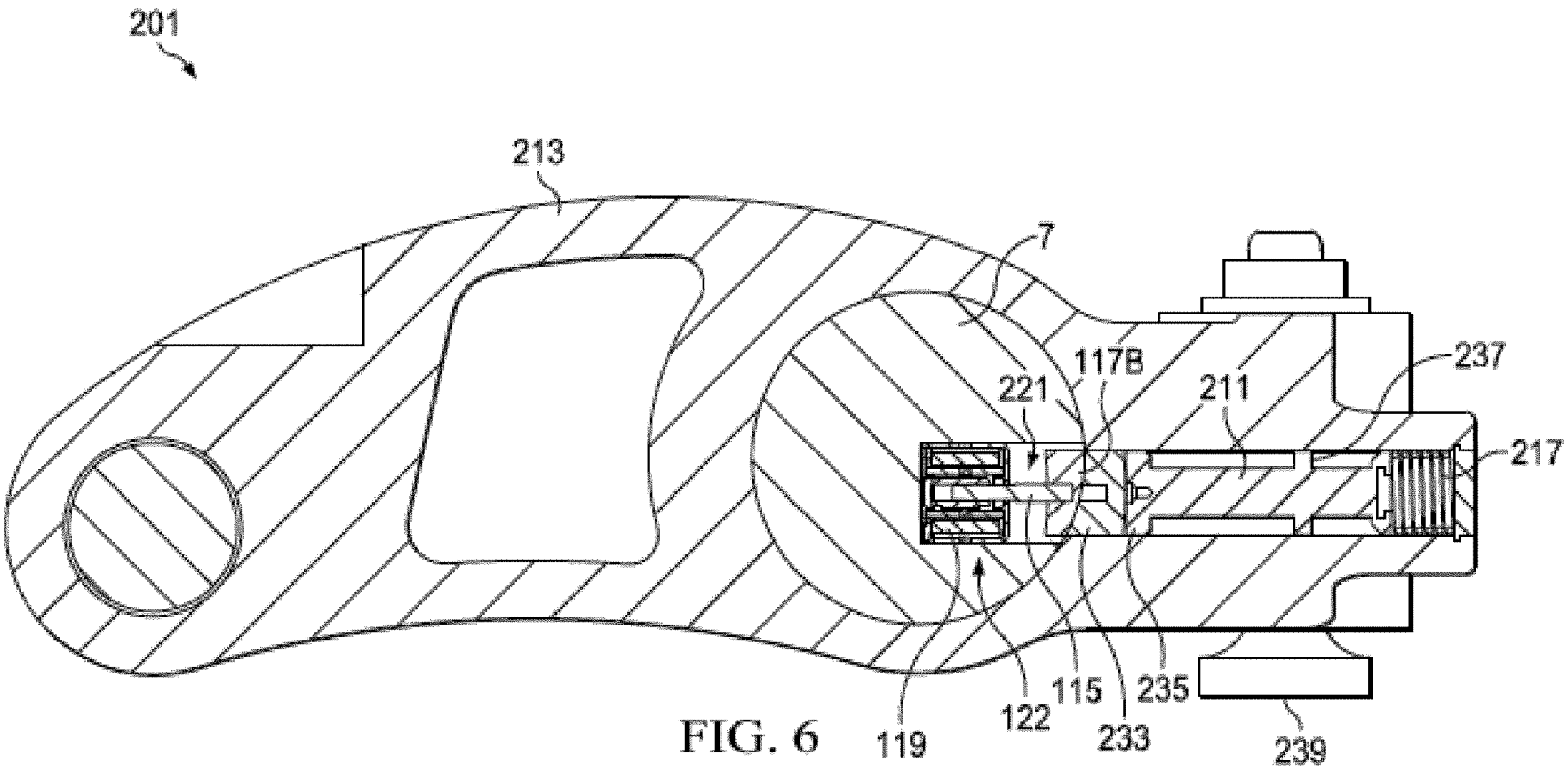
FIG. 6 is a cutaway side view of an engine brake rocker arm according to some aspects of the present teachings with the latch pin in an extended position.
Figure 7:
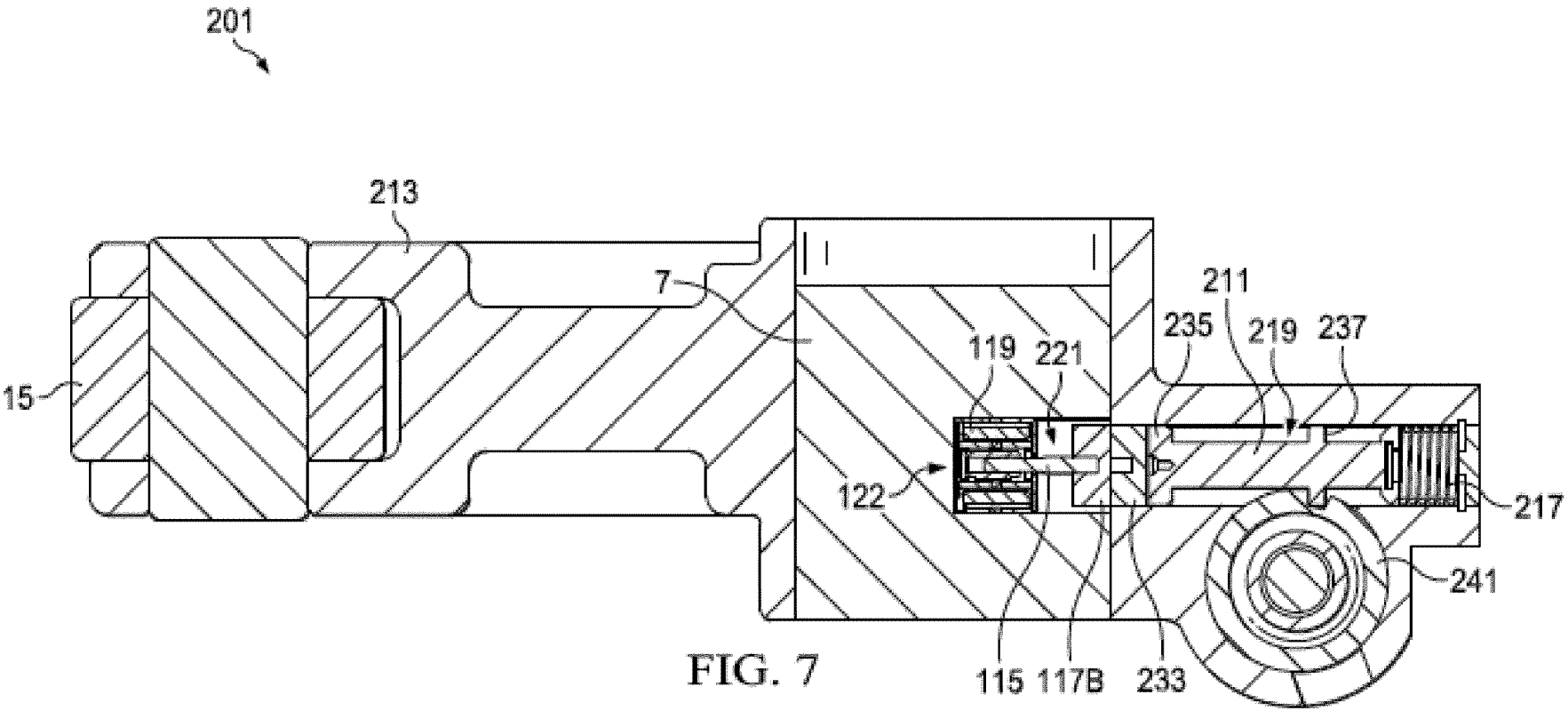
FIG. 7 is a cutaway top view of the engine brake rocker arm of FIG. 6 with the latch pin in the extended position.
Figure 8:
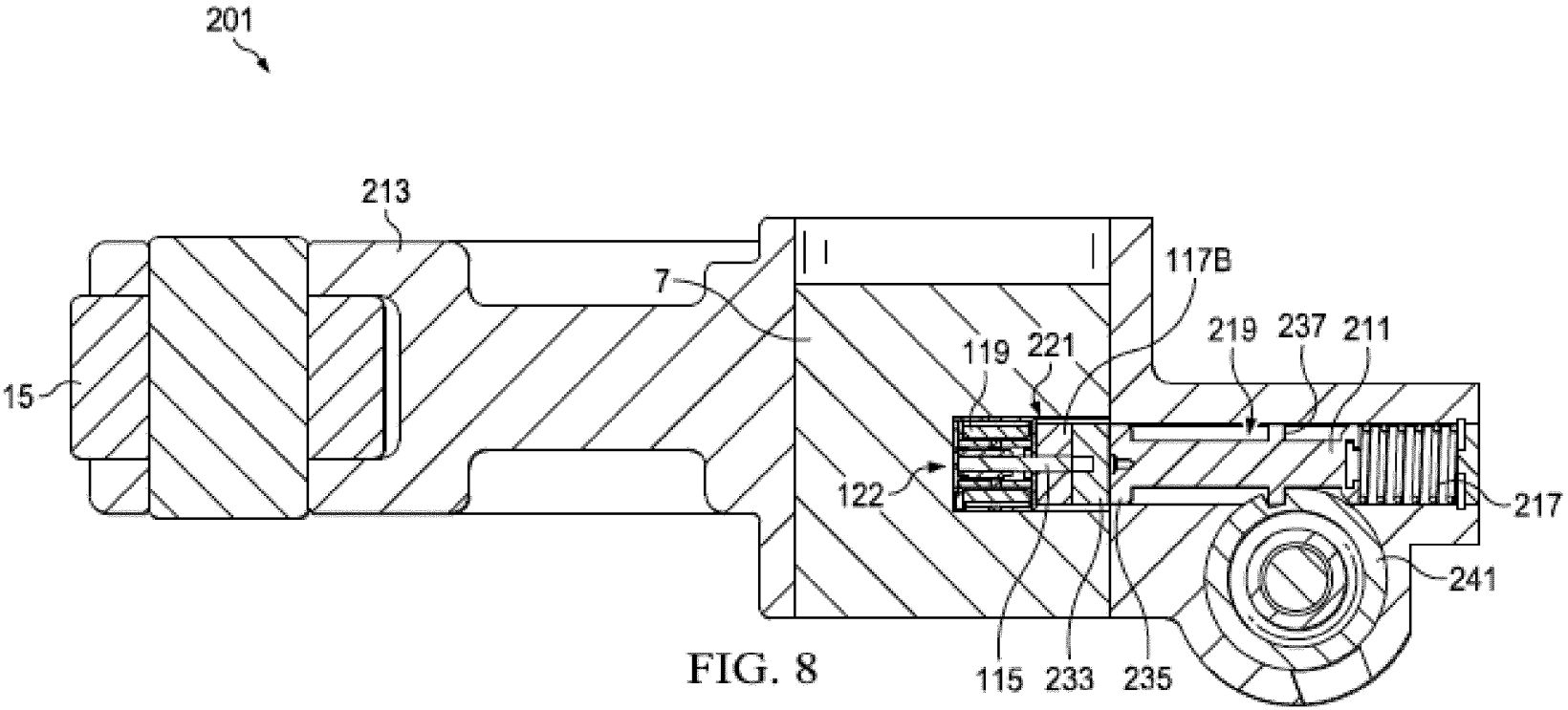
FIG. 8 is the view of FIG. 7, but with the latch pin in a retracted position.
Figure 9:
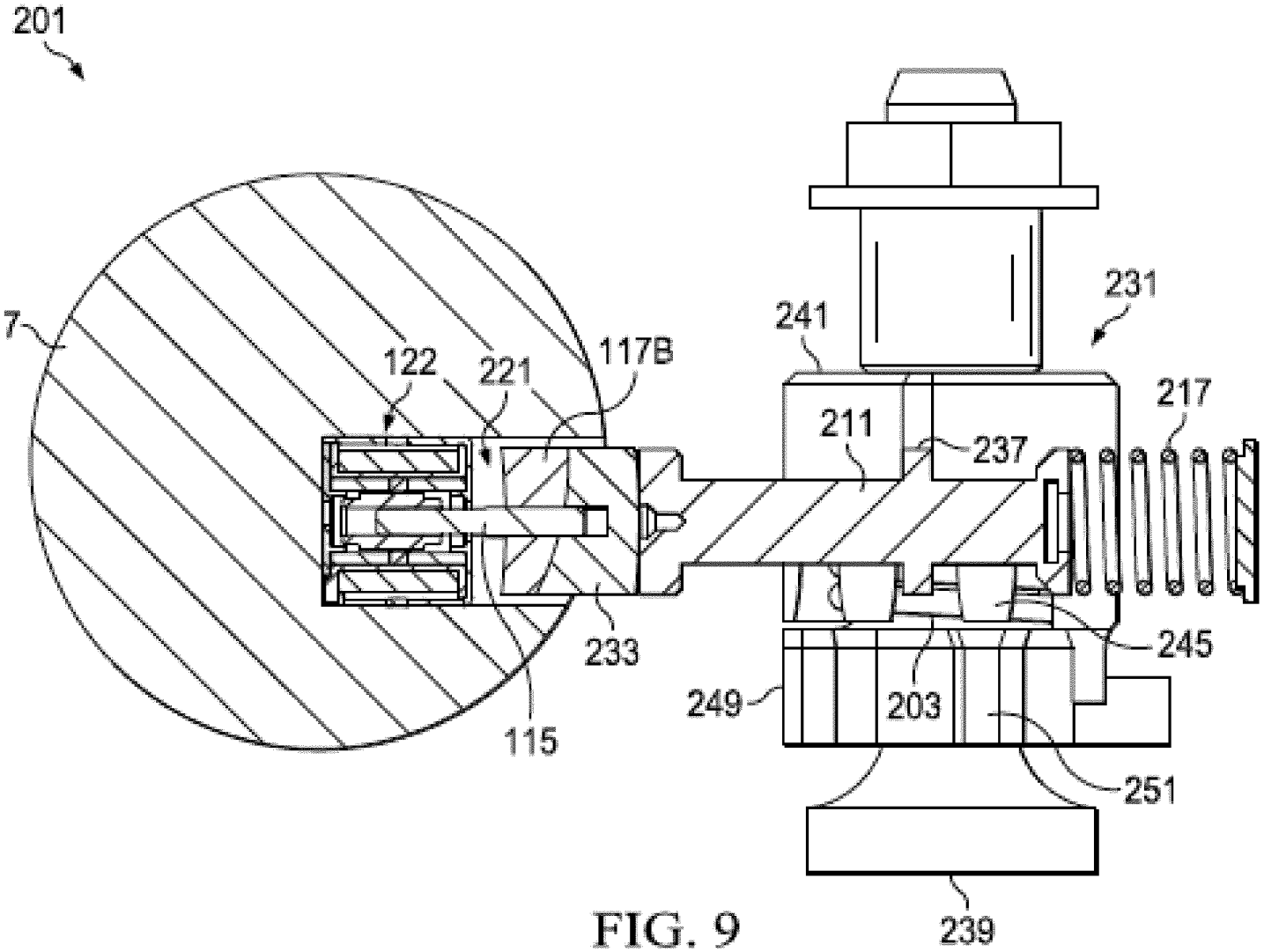
FIG. 9 is a cutaway side view of a rocker arm assembly including the engine brake rocker arm of FIGS. 6-8, showing how retracting the latch pin deactivates the engine brake.

FIGS. 6-10 illustrate an engine brake rocker arm assembly 201 according to some aspects of the present teachings. The engine brake rocker arm assembly 201 may be used in the valvetrain 100. The engine brake rocker arm assembly 201 includes an engine brake rocker arm 213 pivotally mounted on the rocker shaft 7 and a castellation structure 231. A cam follower 15 mounted to the engine brake rocker arm 213 may be actuated by a cam (not shown). An electromagnetic latch assembly 122 housed in the rocker shaft 7 moves the armature 115 between an extended position (FIGS. 6, 7, and 9). Extending and retracting the armature 115 is operative to move an actuation pin 211 housed within a bore 219 formed in the engine brake rocker arm 213 between a first position in which the engine brake rocker arm 213 is deactivated and a second position (FIGS. 8 and 10) in which the engine brake rocker arm 213 is activated.

Figure 10:
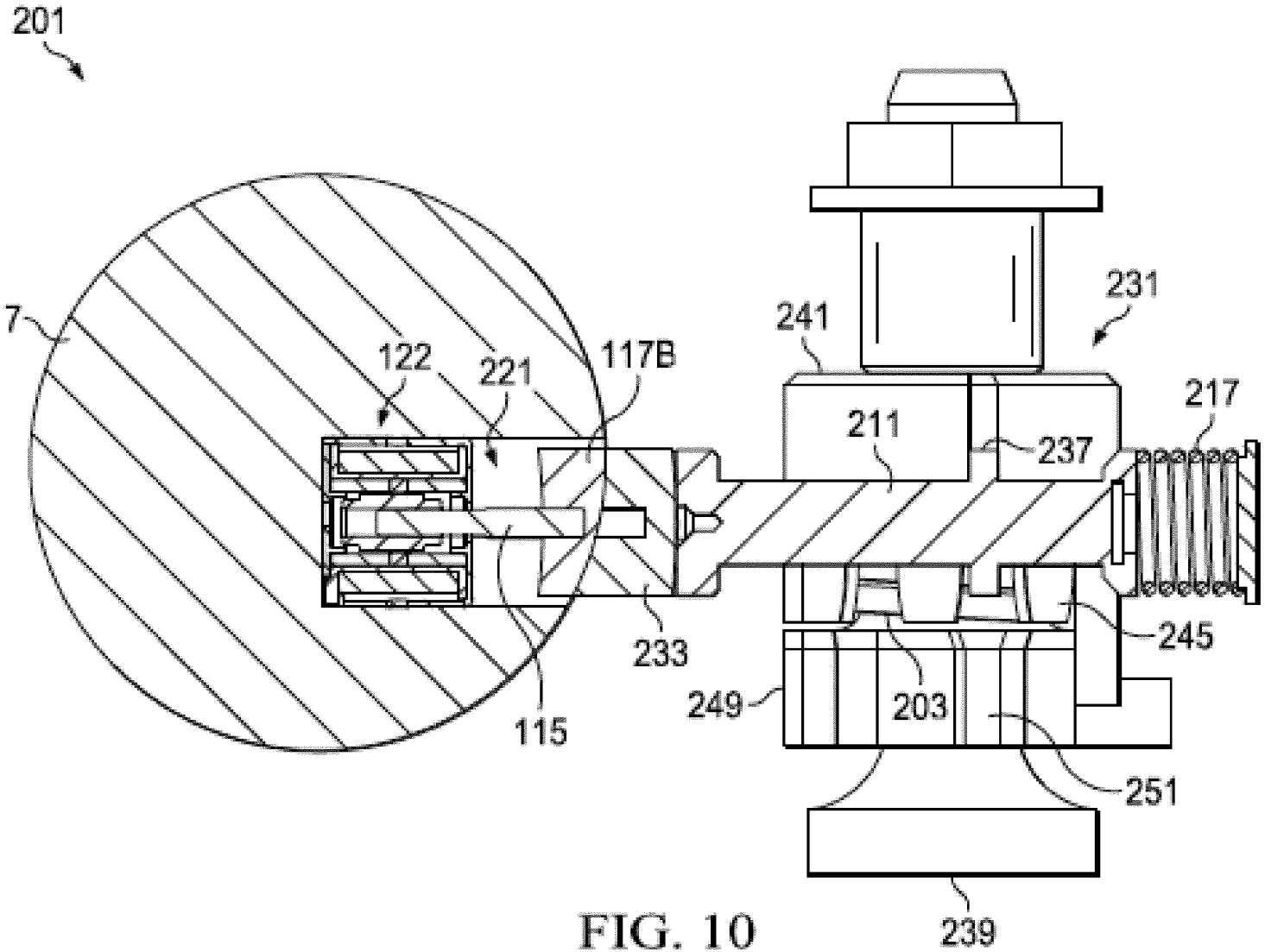
FIG. 10 is the view of FIG. 9 showing how extending the latch pin activates the engine brake.

With reference to FIGS. 9 and 10, the castellation structure 231 includes an upper part 241 and a lower part 249 biased apart by a lost motion spring 203. Extending the armature 115 pushes an actuation pin 211, which has a flange 237 that catches the upper part 241 causing it to rotate to the deactivated position. In the deactivated position, actuating the engine brake rocker arm 213 through the cam follower 15 causes the upper part 241 of the castellation structure 231 to move up and down on the lost motion spring 203 while the lower part 249 remains stationary. In the deactivated position, teeth 245 of the upper part 241 are aligned with slots 251 in the lower part 249.

In the activated position, this alignment is broken. Retracting the armature 115 allows a spring 217 to push the actuation pin 211 causing the upper part 241 to rotate to the activated position. In the activated position, actuating the engine brake rocker arm 213 through the cam follower 15 causes the lower part 249 to descend together with the upper part 241 actuating the valve foot 239 and opening a valve.

When actuated through the cam follower 15, the engine brake rocker arm 213 will rotate on the rocker shaft 7 whether the armature 115 is in the extended or the retracted position. A decoupling disc 233 between the armature 115 and the actuation pin 211 facilitates this action. As the armature 115 is extended and retracted, the decoupling disc 233 passes in and out of an opening 221 in the rocker shaft 7. The entire electromagnetic latch assembly 122 may be installed in the rocker shaft 7 through the opening 221.

The armature 115 interfaces with decoupling disc 233 through a driving member 117B attached to the armature 115. When the armature 115 is extended, the driving member 117B substantially fills the mouth of the opening 221 in the rocker shaft 7. Actuating the engine brake rocker arm 213 in this configuration will cause the decoupling disc 233 to travels over a surface presented by driving member 1176 together with rocker shaft 7. When the armature 115 is retracted, the decoupling disc 233 enters and substantially fills the mouth of the opening 221. Actuating the engine brake rocker arm 213 in this configuration will cause the actuating pin 211 to travel over a surface presented by the decoupling disc 233 together with the rocker shaft 7. A rocker shaft-facing side 235 of the actuation pin 211, the driving member 1176, and both faces of the decoupling disc 233, may be shaped to provide a smoothly rotating interface aligned with an outer surface of the rocker shaft 7. The shapes may include curvature matching that of the rocker shaft 7, diameters equal to the diameter of the opening 221, and slightly rounded or tapered edges.

The components and features of the present disclosure have been shown and/or described in terms of certain teachings and examples. While a particular component or feature, or a broad or narrow formulation of that component or feature, may have been described in relation to only some aspects of the present teachings or some examples, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber, and a moveable valve having a seat formed in the combustion chamber, comprising:

a rocker shaft;

a camshaft;

a rocker arm assembly comprising a cam follower configured to engage a cam mounted on the camshaft as the camshaft rotates and a first rocker arm pivotally mounted on the rocker shaft; and an electromagnetic latch assembly comprising an electromagnet and a pin that translates between a first position and a second position to alter a configuration of the rocker arm assembly;

wherein the electromagnetic latch assembly is powered by a circuit that passes through the rocker shaft.

2. The valvetrain of claim 1, wherein the rocker shaft forms a chamber that houses the electromagnet.

3. The valvetrain of claim 1, wherein:

when the pin is in a first one of the first position and the second position, the first rocker arm pivots on the rocker shaft in response to rotation of the camshaft; and when the pin is in a second one of the first position and the second position, the first rocker arm remains stationary on the rocker shaft as the camshaft rotates.

4. The valvetrain of claim 1, wherein:

the rocker arm assembly further comprises a second rocker arm;

when the pin is in a first one of the first position and the second position, the second rocker arm pivots relative to the first rocker arm in response to rotation of the camshaft; and when the pin is in a second one of the first position and the second position, the second rocker arm is latched to the first rocker arm.

5. The valvetrain of claim 1, wherein the electromagnetic latch assembly comprises a driving member having a same diameter as the electromagnetic latch assembly.

6. The valvetrain of claim 1, wherein:

the first rocker arm pivots on the rocker shaft in relation to rotation of the camshaft both when the pin is in the first position and when the pin is in the second position;

a first one of the first position and the second position provides a configuration in which the rocker arm assembly is operative to actuate a moveable valve in response to rotation of the camshaft to produce a first valve lift profile; and a second one of the first position and the second position provides a configuration in which the rocker arm assembly is operative to actuate the moveable valve in response to rotation of the camshaft to produce a second valve lift profile, which is distinct from the first valve lift profile, or the moveable valve is deactivated.

7. The valvetrain of claim 6, wherein:

the electromagnetic latch assembly comprises a decoupling member and an armature;

the electromagnet is operative to actuate the armature between an extended position and a retracted position;

when the armature is in the retracted position, the decoupling member is inside the rocker shaft; and when the armature is in the extended position, the decoupling member pivots about the rocker shaft with the first rocker arm.

8. The valvetrain of claim 1, wherein the rocker shaft houses a wire through which the electromagnet is powered.

9. The valvetrain of claim 1, wherein:

the electromagnetic latch assembly comprises an armature and the electromagnet is operative to actuate the armature between an extended position and a retracted position;

actuating the armature to the extended position causes the pin to move to the second position;

actuating the armature to the retracted position results in the pin moving to the first position; and the armature is decoupled from the pin.

10. The valvetrain of claim 1, wherein:

the electromagnetic latch assembly comprises an armature and the electromagnet is operative to actuate the armature between an extended position and a retracted position;

the electromagnetic latch assembly provides the armature with positional stability independently from the electromagnet both when the armature is in the extended position and when the armature is in the retracted position.

11. The valvetrain of claim 10, wherein the electromagnetic latch assembly further comprises a permanent magnet that contributes to the positional stability.

12. The valvetrain of claim 11, wherein the permanent magnet is within the electromagnet.

13. The valvetrain of claim 11, wherein the permanent magnet is held stationary with respect to the rocker shaft.

14. A method of providing power to an electromagnetic latch assembly for a valve train that includes a rocker arm mounted on a rocker shaft, the method comprising:

connecting the electromagnetic latch assembly and a power source in a circuit that passes through the rocker shaft; and providing the electromagnetic latch assembly with a pulse through the circuit.

15. The method of claim 14, further comprising using one or more permanent magnets to alternately maintain an armature of the electromagnetic latch assembly in an extended position and a retracted position.

16. A valvetrain for an internal combustion engine including a combustion chamber, a moveable valve having a seat formed in the combustion chamber, and a camshaft, comprising:

a rocker shaft;

a first rocker arm mounted on the rocker shaft; and an electromagnetic latch assembly;

wherein the electromagnetic latch assembly deactivates the first rocker arm; and a coil is powered by a wire that passes through the rocker shaft.

17. The valvetrain of claim 16, wherein the first rocker arm is an engine brake rocker arm.

18. The valvetrain of claim 16, wherein the coil actuates a latch pin that selectively engages the first rocker arm and a second rocker arm.

19. The valvetrain of claim 16, wherein the coil is inside the rocker shaft.

20. The valvetrain of claim 16, wherein:

the electromagnetic latch assembly comprises a decoupling member and an armature;

the electromagnet is operative to actuate the armature between an extended position and a retracted position;

when the armature is in the retracted position, the decoupling member is inside the rocker shaft; and when the armature is in the extended position, the decoupling member pivots about the rocker shaft with the first rocker arm.

* * * * *